US010770047B2

(12) United States Patent
Litovsky et al.

(10) Patent No.: US 10,770,047 B2
(45) Date of Patent: Sep. 8, 2020

(54) ELECTRIC MUSICAL INSTRUMENT HAVING REAR MOUNTED SPEAKER

(71) Applicant: Bose Corporation, Framingham, MA (US)

(72) Inventors: Roman N. Litovsky, Newton, MA (US); Mikhail Ioffe, Newton, MA (US); Michael Tiene, Franklin, MA (US); Robert Alan Lituri, Chelmsford, MA (US)

(73) Assignee: Bose Corporation, Framingham, MA (US)

( * ) Notice: Subject to any disclaimer, the term of this patent is extended or adjusted under 35 U.S.C. 154(b) by 136 days.

(21) Appl. No.: 16/248,301

(22) Filed: Jan. 15, 2019

(65) Prior Publication Data

US 2020/0227015 A1 Jul. 16, 2020

(51) Int. Cl.

| | |
|---|---|
| ***G10H 1/32*** | (2006.01) |
| ***G10H 3/18*** | (2006.01) |
| ***H04R 1/02*** | (2006.01) |

(52) U.S. Cl.

CPC ..... *G10H 1/32* (2013.01); *G10H 3/18* (2013.01); *H04R 1/028* (2013.01); *G10H 2220/461* (2013.01)

(58) Field of Classification Search

CPC ..... G10H 1/32; G10H 3/18; G10H 2220/461; H04R 1/028

USPC ..... 84/602

See application file for complete search history.

(56) References Cited

U.S. PATENT DOCUMENTS 3,357,291 A * 12/1967 Carmichael ..... G10D 1/085 84/267
3,733,953 A * 5/1973 Ferber ..... G10H 3/181 84/724
3,781,451 A * 12/1973 Nolan ..... G10H 1/0083 84/723

(Continued)

FOREIGN PATENT DOCUMENTS

| | | |
|---|---|---|
| JP | 2004129058 | 4/2004 |
| JP | 2010136313 | 6/2010 |

(Continued)

OTHER PUBLICATIONS

International Search Report and Written Opinion in International Appln. No. PCT/US2020-013440, dated Mar. 26, 2020, 12 pages.

(Continued)

*Primary Examiner* — David S Warren

(74) *Attorney, Agent, or Firm* — Fish & Richardson P.C.

(57) ABSTRACT

An electric musical instrument includes a body having a front side and a rear side, a plurality of strings extending across at least a portion of the front side of the body, and at least one electric pickup to detect vibrations of the strings and generate a pickup signal. The instrument includes at least one speaker mounted at the rear side of the body, in which the speaker includes an acoustic driver and an acoustic deflector. The acoustic deflector is configured to receive acoustic energy propagating from the acoustic driver and deflect at least a portion of the acoustic energy. The instrument includes an amplifier to amplify the pickup signal to generate an amplified pickup signal, and drive the at least one speaker based on the amplified pickup signal.

30 Claims, 11 Drawing Sheets

(56) References Cited

U.S. PATENT DOCUMENTS

| | | | | | |
|---|---|---|---|---|---|
| 4,245,540 | A * | 1/1981 | Groupp | G10H 3/26 | 84/726 |
| 4,312,258 | A * | 1/1982 | Park | G10D 1/085 | 181/150 |
| 4,464,967 | A | 8/1984 | Trimborn | | |
| 5,056,400 | A * | 10/1991 | Wachi | G10H 3/18 | 84/600 |
| 5,262,586 | A * | 11/1993 | Oba | G10C 3/00 | 84/723 |
| 5,889,221 | A * | 3/1999 | Dejima | G10D 1/085 | 84/267 |
| 5,929,362 | A * | 7/1999 | Oteyza | G10D 1/085 | 84/293 |
| 6,605,765 | B1 * | 8/2003 | Johnson | G10D 1/00 | 84/267 |
| 7,355,110 | B2 | 4/2008 | Nash | | |
| 7,671,268 | B2 * | 3/2010 | Nicoll | G10H 1/32 | 84/718 |
| 7,674,963 | B1 * | 3/2010 | Poggi | G10D 3/02 | 84/312 R |
| 8,481,832 | B2 | 7/2013 | Lloyd | | |
| 8,687,836 | B2 | 4/2014 | Lin | | |
| 8,794,373 | B1 | 8/2014 | Lin | | |
| 8,991,549 | B2 | 3/2015 | Lin | | |
| 9,012,758 | B2 * | 4/2015 | El-Khadem | G10H 1/32 | 84/723 |
| 9,093,057 | B2 * | 7/2015 | Mejia | G10H 1/02 | |
| 9,232,299 | B2 | 1/2016 | Lin | | |
| 9,357,289 | B2 | 5/2016 | Lin | | |
| 9,544,681 | B2 | 1/2017 | Kim et al. | | |
| 9,691,371 | B1 | 6/2017 | Lin et al. | | |
| 9,749,735 | B1 | 8/2017 | Silver et al. | | |
| 10,206,020 | B2 * | 2/2019 | Zuccaro | G10H 3/186 | |
| 10,542,347 | B2 * | 1/2020 | Petracek | H04R 1/02 | |
| 2003/0154842 | A1 * | 8/2003 | Steiger | G10D 1/085 | 84/267 |
| 2004/0244566 | A1 * | 12/2004 | Steiger | G10H 1/342 | 84/610 |
| 2008/0184864 | A1 * | 8/2008 | Holt | G10H 3/186 | 84/267 |
| 2009/0071317 | A1 * | 3/2009 | Nicoll | G10H 3/146 | 84/726 |
| 2009/0199695 | A1 * | 8/2009 | Schmidt | G10D 3/02 | 84/291 |
| 2009/0282965 | A1 * | 11/2009 | Matejka | G10H 1/0016 | 84/611 |
| 2014/0013929 | A1 * | 1/2014 | El-Khadem | G10H 1/32 | 84/726 |
| 2014/0224099 | A1 * | 8/2014 | Webman | G10H 3/18 | 84/630 |

FOREIGN PATENT DOCUMENTS

| | | |
|---|---|---|
| JP | 2015079272 | 4/2015 |
| WO | WO 00/54250 | 9/2000 |
| WO | WO 2016/1688871 | 10/2016 |

OTHER PUBLICATIONS

"The Fusion Guitar," Fusion Guitars, 2017, 16 pages, retrieved from URL <https://fusionguitars.com/>.

Fanelli, "All-in-One Fusion Guitar Has Built-In Amp and iPhone Dock," Guitar World, 2016, 4 pages, retrieved from URL <https://www.guitarworld.com/gear/all-one-fusion-guitar-has-built-amp-and-iphone-dock>.

Ridden, "Unlimited guitar with built-in amp comes with smartphone-based digital effects," New Atlas, 2012, 9 pages, retrieved from URL <https://newatlas.com/unlimited-smartphone-electric-guitar/23120/>.

* cited by examiner

ELECTRIC MUSICAL INSTRUMENT HAVING REAR MOUNTED SPEAKER

TECHNICAL FIELD

The description relates to an electric musical instrument having one or more rear mounted speakers.

BACKGROUND

In some examples, an electric guitar includes a body, strings, and one or more pickups for detecting vibrations of the strings. For example, a magnetic pickup can be used in which the pickup includes magnets wrapped with coils of wire that react to disturbances caused by the guitar's vibrating metal strings. A pickup designed for a multi-string guitar can have multiple poles, each pole corresponding to the string positioned above it. Plucking a string causes the pickup to produce an electronic signal that corresponds to the string's vibrations. The electric guitar may include an output jack for connecting a guitar cable to an external power amplifier, which in turn drives a speaker. In some examples, characteristics of the guitar cable, such as the length of the cable, may affect the electric guitar's tone in the speaker output. The guitar cable has an impedance that in combination with the impedance of the pickup and amplifier results in an overall impedance that affects the electric signals generated by the pickup. Different guitar cables have different impedances and may affect the pickup output signals differently. The power amplifier may be connected to an equalizer or other equipment for producing desired sound effects. The electric guitar may include an audio jack for connecting to a headphone.

SUMMARY

This document describes an electric musical instrument that includes a body, strings that extend across at least a portion of the front side of the body, and one or more speakers positioned at a rear side of the body. For example, the electric musical instrument can be an electric guitar, an electric bass guitar, an electric violin, an electric viola, an electric cello, an electric double bass, an electric banjo, an electric mandolin, or an electric ukulele.

In a general aspect, an electric musical instrument includes a body having a front side and a rear side; a plurality of strings extending across at least a portion of the front side of the body; at least one electric pickup to detect vibrations of the strings and generate a pickup signal; at least one speaker mounted at the rear side of the body, the speaker comprising an acoustic driver and an acoustic deflector, and the acoustic deflector is configured to receive acoustic energy propagating from the acoustic driver and deflect acoustic energy; and an amplifier to amplify the pickup signal to generate an amplified pickup signal, and drive the at least one speaker based on the amplified pickup signal.

Implementations of the electric musical instrument can include one or more of the following features. The acoustic deflector can include a ring radiator which causes the acoustic energy to be radiated along a circular opening. The circular opening can be disposed along an outer circumference of the ring radiator. The acoustic deflector can include an acoustically reflective body, and the acoustically reflective body can have a truncated conical shape. The acoustic deflector can include a cap and an acoustic resistive material, in which the cap, the acoustic resistive material, and at least a portion of the truncated conical shaped reflective body can define a volume, and the acoustic resistive material can be configured to enable at least a portion of the acoustic energy received from the acoustic driver to pass the acoustic resistive material and enter the volume between the acoustic resistive material and the cap. The acoustic deflector can include an internal volume and an acoustic resistive mesh positioned between the acoustic driver and the internal volume of the acoustic deflector. A first speaker and a second speaker can be mounted at the rear side of the body, each of the first speaker and the second speaker comprise an acoustic driver and an acoustic deflector, and the acoustic deflector is configured to receive acoustic energy propagating from the acoustic driver and deflect acoustic energy.

The electric musical instrument can include an electronic circuit to process the pickup signal, in which the electronic circuit includes a tone control unit configured to adjust a tone of the pickup signal, and a terminal of the tone control unit is electrically coupled to an input of a high impedance buffer configured to generate an output signal having a voltage level that is substantially the same as a voltage level at the input, wherein the high impedance buffer has an input impedance of at least 10 Mega-ohms. The electric musical instrument can include a switch to select between a first mode and a second mode, in which when the first mode is selected, the electronic circuit can be configured to provide the pickup signal that is adjusted by the tone control unit to an output jack of the electric musical instrument. When the second mode is selected, the electronic circuit can be configured to provide the output signal from the high impedance buffer to the output jack of the electric musical instrument. The first mode can include an electric guitar mode and the second mode can include an acoustic guitar mode, the electric guitar mode can produce at the output jack an audio signal that resembles an audio signal produced by a conventional electric guitar, and the acoustic guitar mode can produce at the output jack an audio signal that resembles an audio signal produced by a conventional acoustic guitar.

The electric musical instrument can be configured such that there is no speaker at the front side of the body. The electric musical instrument can include air adsorbing material disposed in the acoustic chamber to produce an apparent volume that is larger than an actual volume of the acoustic chamber. The electric musical instrument can include a digital signal processor configured to process the pickup signal by applying a selected frequency response curve to the pickup signal, in which the selected frequency response can be selected from a plurality of pre-stored frequency response curves. The electric musical instrument can include a user interface configured to control an amount by which the digital signal processor suppresses signal components representing acoustic feedback from the speaker to the pickup. Each of the plurality of frequency response curves can be configured to enable the digital signal processor to modify the pickup signal to cause an output of the speaker to resemble a particular guitar or a particular group of guitars. The electric musical instrument can include a storage device configured to store data representing the frequency response curves, and a communication module configured to communicate with a computing device to enable downloading the data representing the frequency response curves from the computing device.

The electric musical instrument can include an electric guitar, an electric bass guitar, an electric violin, an electric viola, an electric cello, an electric double bass, an electric banjo, an electric mandolin, or an electric ukulele. The speaker can protrude from the rear side of the body, the speaker can have a top surface that is substantially parallel to a portion of the rear side of the body adjacent to the speaker, and at least one opening can be provided between an edge of the top surface and the portion of the rear side of the body adjacent to the speaker to enable sound to be emitted through the at least one opening.

In another general aspect, a method includes: detecting, using at least one electric pickup, vibrations of strings that extend across at least a portion of a front side of a body of an electric musical instrument and generate a pickup signal; amplifying, using an amplifier, the pickup signal to generate an amplified pickup signal, and driving at least one speaker mounted at a rear side of the body based on the amplified pickup signal, in which the front side and the rear side are at opposite sides of the body, and the speaker includes an acoustic driver and an acoustic deflector; emitting, from the acoustic driver, acoustic energy; and deflecting, using the acoustic deflector, at least a portion of the acoustic energy received from the acoustic driver.

Implementations of the method can include one or more of the following features. The acoustic deflector can include a ring radiator, which directs the acoustic energy to be radiated along a circular opening. The method can include directing, using the ring radiator, the acoustic energy through openings disposed along an outer circumference of the ring radiator and propagating the acoustic energy from points along the circular opening. Driving at least one speaker mounted at a rear side of the body can include driving at least a first speaker and a second speaker mounted at the rear side of the body, each of the first speaker and the second speaker can include an acoustic driver and an acoustic deflector, and the acoustic deflector can be configured to receive acoustic energy propagating from the acoustic driver and deflect at least a portion of the acoustic energy. The method can include driving, using a high impedance buffer, an output jack based on the pickup signal, in which the high impedance buffer has an input impedance greater than 10 Mega-ohms.

The method can include enabling user selection between an electric guitar mode and an acoustic guitar mode, wherein upon user selection of the acoustic guitar mode, driving, using a high impedance buffer, an output jack based on a volume-adjusted and tone-adjusted pickup signal, in which the high impedance buffer has an input impedance greater than 10 Mega-ohms, and wherein upon user selection of the electric guitar mode, driving the output jack based on the volume-adjusted and tone-adjusted pickup signal without using the high impedance buffer. The electric musical instrument can be configured such that no speaker is provided at the front side of the body. The method can include disposing air adsorbing material in an acoustic chamber in the body to produce an apparent volume that is larger than an actual volume of the acoustic chamber, while the rear side of the speaker faces the acoustic chamber. The method can include controlling a sustain effect of the electric musical instrument by controlling an amount of feedback from the speaker to the pickup.

The method can include processing the pickup signal by applying a selected frequency response curve to the pickup signal, in which the selected frequency response is selected from a plurality of pre-stored frequency response curves. Each of the plurality of frequency response curves can be configured to enable the pickup signal to be modified to cause an output of the speaker to resemble a particular guitar or a particular group of guitars. The method can include communicating, through a communication module, with a computing device and downloading data representing at least one of the frequency response curves, tones, or other sound effects from the computing device, and storing, at a storage device, the downloaded data representing at least one of the frequency response curves, tones, or other sound effects. The electric musical instrument can include at least one of an electric guitar, an electric bass guitar, an electric violin, an electric viola, an electric cello, an electric double bass, an electric banjo, an electric mandolin, or an electric ukulele.

The aspects described above can be embodied as systems, methods, computer programs stored on one or more computer storage devices, each configured to perform the actions of the methods, or means for implementing the methods. A system of one or more computing devices can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

Unless otherwise defined, all technical and scientific terms used herein have the same meaning as commonly understood by one of ordinary skill in the art to which this invention belongs. In case of conflict with patents or patent applications incorporated herein by reference, the present specification, including definitions, will control.

Other features and advantages of the description will become apparent from the following description, and from the claims.

DETAILED DESCRIPTION

In this document we describe a novel electric string instrument, such as an electric guitar, having at least one speaker mounted on a rear side of the instrument. In some implementations, the instrument includes a body, a neck, at least one string on the neck, and at least one pickup near the string(s) to convert vibrations of the string(s) to electrical signals. Here, the front side of the instrument refers to the side where the string(s) are located, and the rear side of the instrument refers to the other side of the instrument. For example, when the user (e.g., musician) plays the instrument in a normal manner, the front side of the instrument faces the audience and the rear side of the instrument faces the user. A feature of the invention is that the speaker includes a ring radiator having side openings configured to radiate sound in a radial direction so that when the rear side of the instrument is pressed against the user's body, sound can radiate from the side openings and not be obstructed by the user's body.

In the following, we describe an electric guitar having one or more rear-mounted speakers. The invention can also be applied to other types of electric string instruments, such as an electric bass, an electric banjo, an electric mandolin, an electric violin, an electric viola, or an electric cello.

Figure 1:
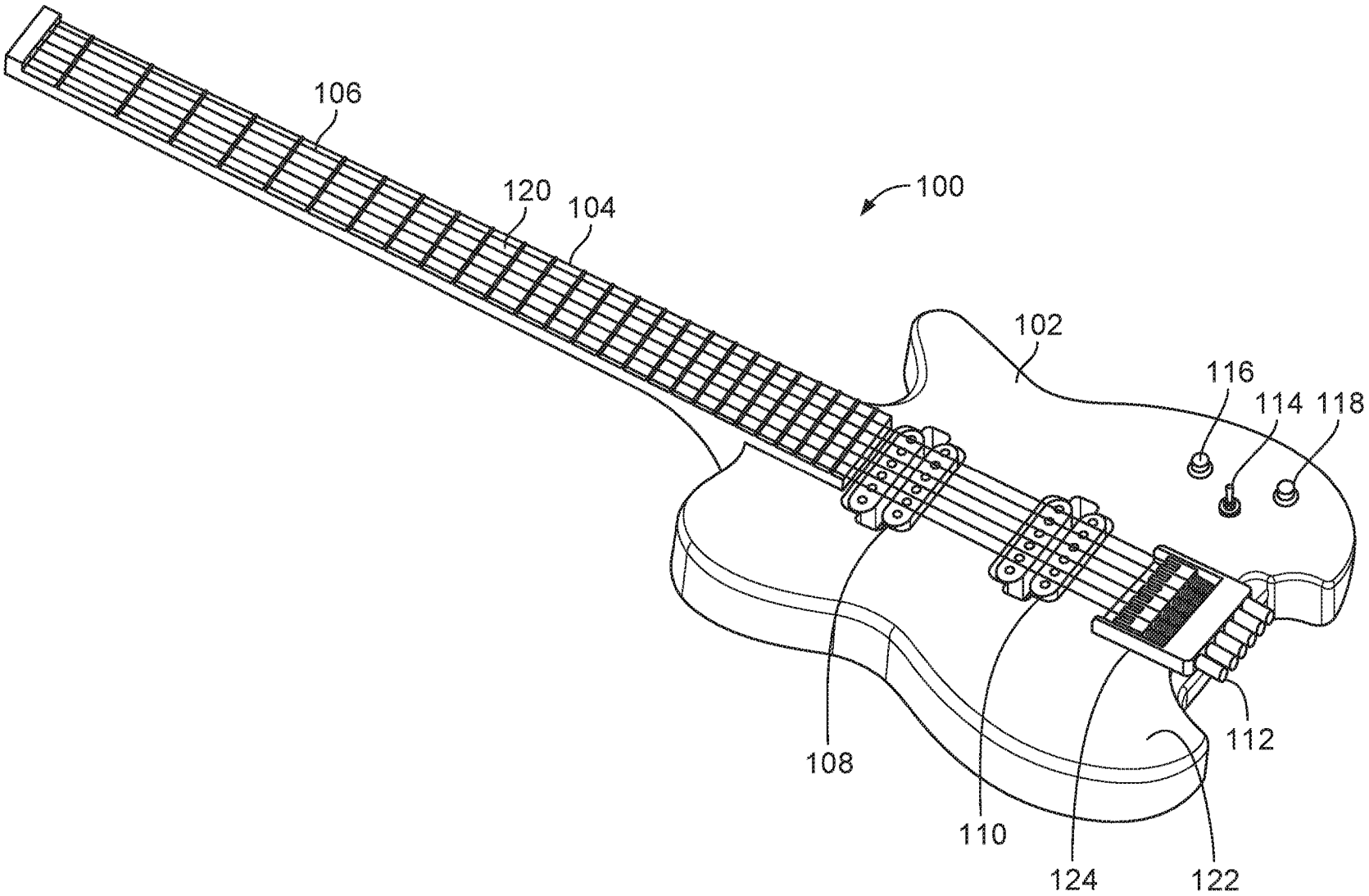
FIGS. 1, 2A, and 2B are diagrams of an example electric guitar.

Referring to FIG. 1, an example electric guitar 100 includes a body 102, a neck 104, and strings 106 extending across the neck 104 and the body 102, and terminate at a bridge 124. The figure shows the front side 122 of the guitar 100. The neck 104 includes fretboard 120 that includes several frets. A first electric pickup 108 is positioned under the strings 106 near the neck 104, and a second electric pickup 110 is positioned under the strings 106 near the bridge 124. Each of the first and second electric pickups 108, 110 can be, e.g., a piezoelectric pickup or a magnetic pickup such as a Humbucker pickup. A tuning mechanism 112 is provided for tuning the tension of the strings 106. A toggle switch 114 is provided to allow the user to select the electric pickup 108, the electric pickup 110, or both. A volume control knob 116 is provided for controlling the sound volume, and a tone control knob 118 is provided for controlling the tone of the guitar sound. The front side 122 of the electric guitar 100 looks similar to a conventional electric guitar that does not have any speaker.

Figure 2A:
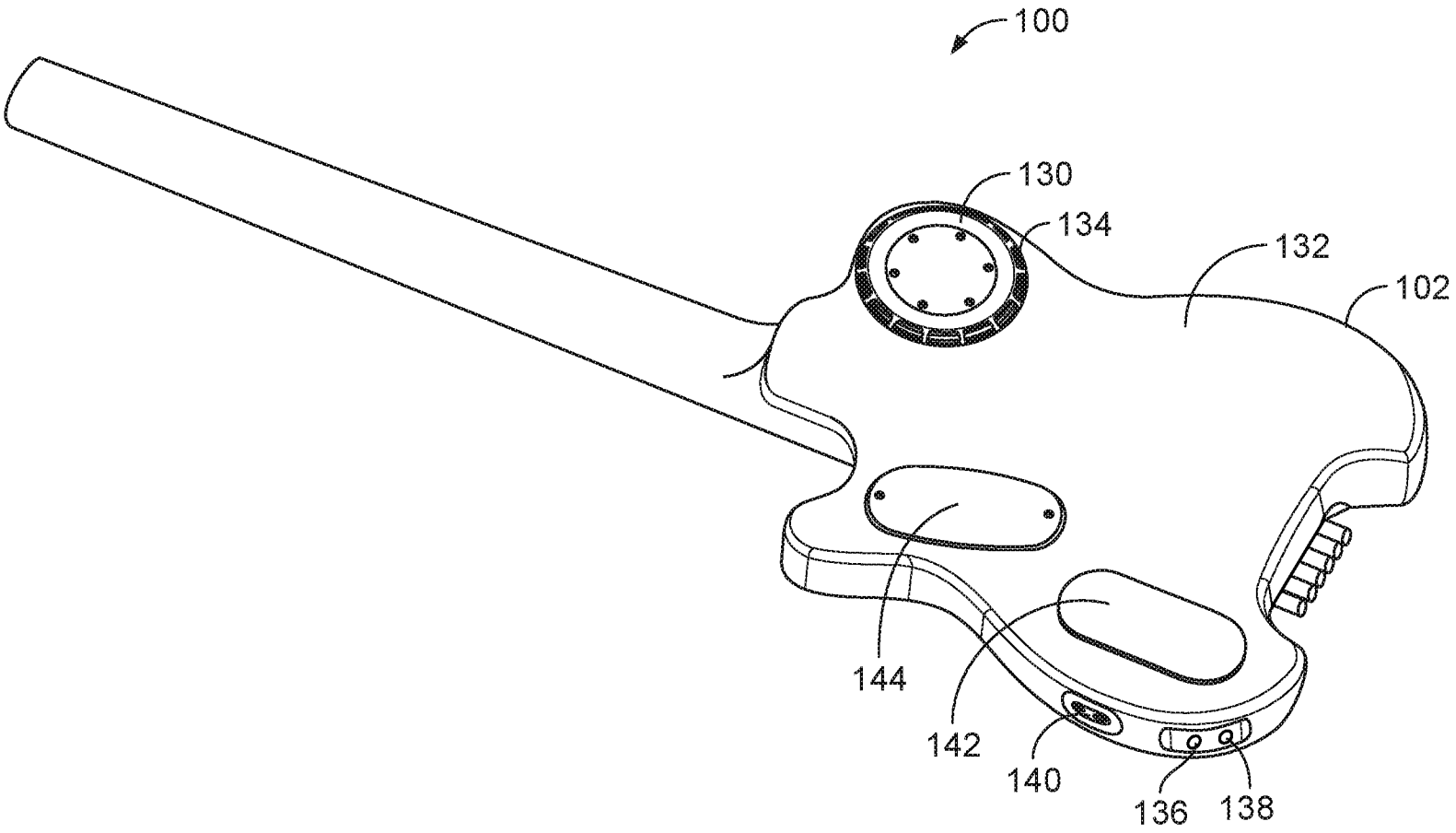
Figure 2B:
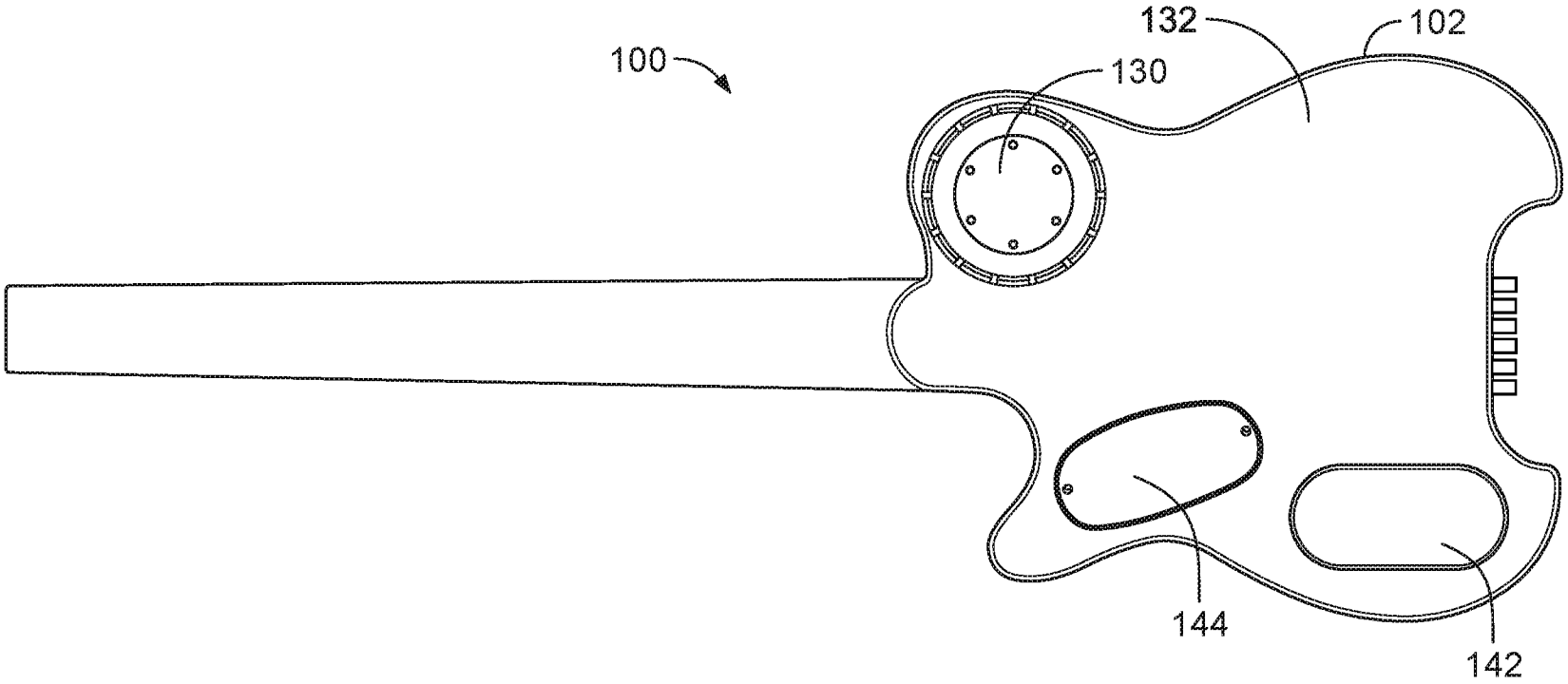

Referring to FIGS. 2A and 2B, the electric guitar 100 includes a speaker 130 installed at a rear side 132 of the body 102. In some implementations, the speaker 130 slightly protrudes from the rear side 132 of the guitar body 102 and has side openings 134 in a radial direction so that the sound from the speaker 130 is emitted in a radial direction. Radiating sound in a radial direction prevents the sound to be muffled by the user when the rear side 132 of the body 102 is positioned close to the user or pressed against the user. An advantage of positioning the speaker 130 at the rear side 132 of the electric guitar 100 is that the sound emitting from the speaker 130 will not be affected by the movements of the user's hand as the user strums the strings. Because there is little movement at the rear side of the electric guitar 100, the sound emitted from the speaker 130 at the rear of the guitar 100 can have a consistent volume. By comparison, for an electric guitar having a speaker installed on the front side of the guitar, when the user's hand is at a position directly over the speaker, the sound may be partially blocked by the user's hand. As the user strums the string, the hand moves back and forth across the front of the speaker, causing the sound level to fluctuate.

An output jack 136 is provided for connecting a guitar cable to an external amplifier. An audio jack 138 is provided for connecting to a headphone. A digital input/output interface, such as a USB port 140, is provided for connecting to a computer. An enclosure 142 is provided to house stock electronics that are standard among electric guitars. For example, the stock electronics can include a three-way switch for selecting the pickup 108, the pickup 110, or both. An enclosure 144 is provided to house additional electronic components useful for this invention, such as a digital signal processor, amplifier and a battery.

In the example of FIGS. 2A and 2B, the speaker 130 is positioned offset from the center line of the rear side 132 of the body 102. The rear surface of the body 102 is divided by a plane into a left portion and a right portion, the plane is substantially perpendicular to the rear surface and passes a center axis of the neck, and at least 80% of the speaker is located in either the left portion or the right portion.

To reduce the amount of feedback from the speaker 130 to the pickup 108 and/or 110 through the body 102, a soft gasket is placed between the speaker 130 and the body 102.

Figure 3:
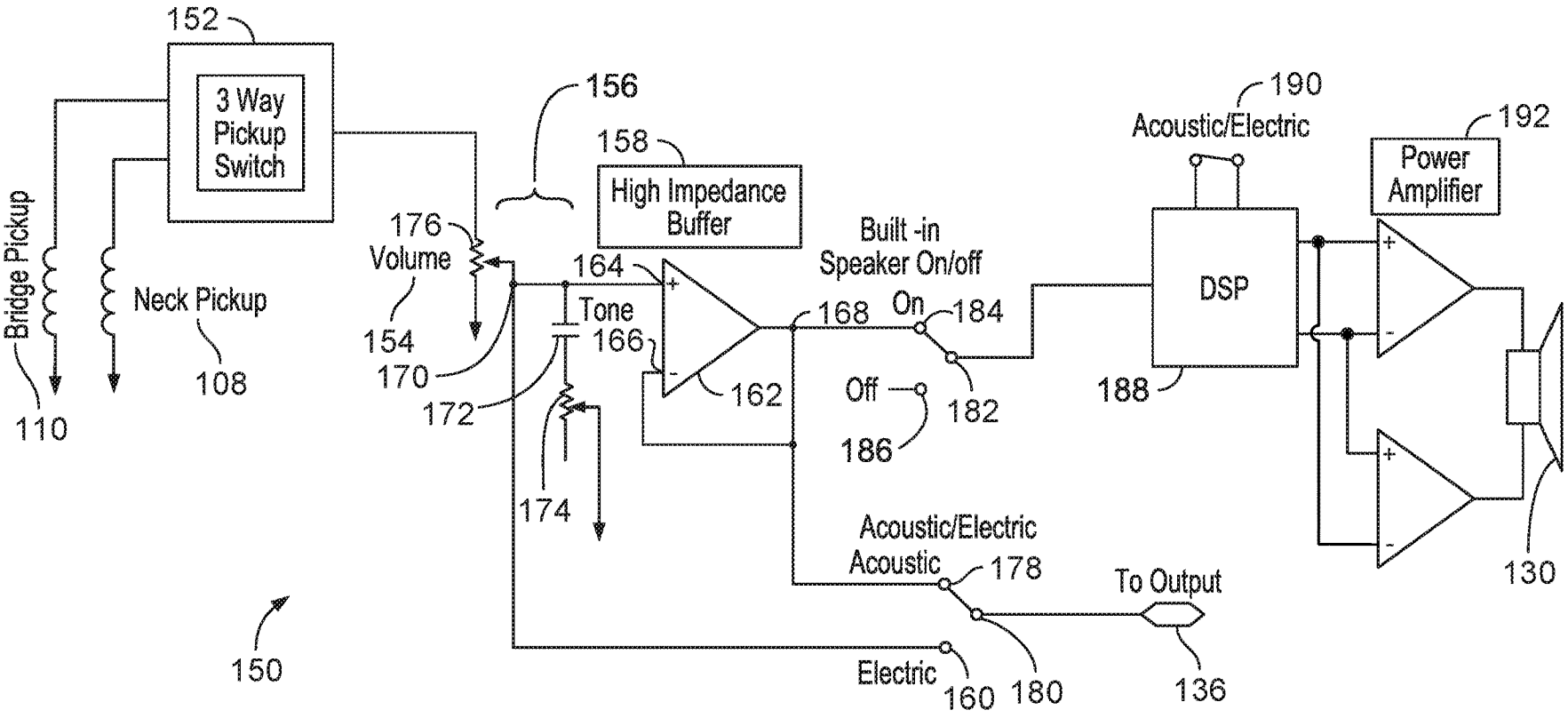
FIG. 3 is a circuit diagram of an example electric system of the electric guitar.

FIG. 3 shows a circuit diagram of an example electric system 150 of the electric guitar 100. The neck pickup 108 and the bridge pickup 110 are electrically connected to a three-way pickup switch 152 that allows the user to select using the neck pickup 108 individually, the bridge pickup 110 individually, or both the neck pickup 108 and the bridge pickup 100 for detecting the string vibrations. The output of the three-way pickup switch 152 is provided to a volume control unit 154, which includes potentiometer 176. The user can manually adjust the signal level at the potentiometer 176 using the volume control knob 116 on the front side 122 of the electric guitar 100. The output of the volume control unit 154 is connected to a node 170, which is connected to a tone control unit 156 that includes a capacitor 172 and a variable resistor 174. The user can manually adjust the resistance of the variable resistor 174 using the tone control knob 118 on the front side 122 of the electric guitar 100.

An acoustic/electric guitar mode selection switch 180 is provided to allow the user to select a first terminal 160 for the electric guitar mode or a second terminal 178 for the acoustic guitar mode. When the user selects the electric guitar mode, the node 170 (which is electrically coupled to the first terminal 160) is electrically coupled to the output jack 136. This configuration allows the output jack 136 to output a signal that has the characteristics of a conventional electric guitar output signal.

When a cable is connected to the output jack 136, the cable becomes part of the overall electric circuit. The impedance of the cable in combination with the impedance of the pickup (108 or 110 or both) affects the overall frequency response of the electric circuit. Typically, a shorter cable causes the frequency response peak to occur at a higher frequency, whereas a longer cable causes the frequency response peak to occur at a lower frequency. Sometimes when a musician finds a cable that produces a desired frequency response from the electric guitar 100, the musician will continue to use the same cable to maintain the desired guitar sound.

The node 170 is electrically coupled to a high impedance buffer 158 that includes an operational amplifier 162 that has a high input impedance (e.g., at least 10 Me). The node 170 is electrically connected to a positive input terminal 164 of the operational amplifier 162, and the output terminal 168 of the operational amplifier 162 is fed back to a negative input terminal 166 of the operational amplifier 162. The voltage level at the output terminal 168 closely follows the voltage level at the positive input terminal 164. The output terminal 168 is electrically coupled to the second terminal 178 that when selected allows the output jack 136 to output a signal that has flat frequency response up to at least 15 kHz, resembling sound characteristics of a conventional acoustic guitar.

A built-in speaker on/off switch 182 allows the user to select a first terminal 184 for outputting the guitar signals to the built-in speaker 130 or a second terminal 186 for not outputting the guitar signals to the built-in speaker 130. The output terminal 168 of the operational amplifier 162 is electrically coupled to the first terminal 184 of the switch 182. When the first terminal 184 is selected, the output signal of the operational amplifier 162 is provided to a digital signal processor (DSP) 188 that can process the signal to produce various equalization curves and sound effects.

One particular effect is unique to this particular implementation. As sound emitted from the speaker is transmitted physically to the strings, this induces new movement in the strings, effectively creating a natural "sustain" effect on the notes played by the user. The digital signal processor can then provide control over the effect, not by creating it, but by controllably suppressing it through echo-cancellation or other appropriate filtering.

The digital signal processor 188 includes, e.g., an analog-to-digital converter that digitizes the input signal to generate digital samples of the input signal. The digital audio data are processed using digital processing algorithms. For example, the digital signal processor 188 can output sounds having tonal characteristics that are similar to those of an acoustic guitar or an electric guitar. A switch 190 is provided to allow the user to select the sound effects of the digital signal processor 188. In this example, the user can select between an acoustic guitar mode or an electric guitar mode. The output signal of the digital signal processor 188 is provided to a power amplifier 192 that drives the built-in speaker 130.

In some implementations, the digital signal processor 188 communicates with a computer, such as a desktop computer or a laptop computer, through a USB cable. A user interface is provided on the computer to allow the user to adjust the frequency response curve that the digital signal processor 188 applies to the guitar sound. In some implementations, the digital signal processor 188 communicates wirelessly with a mobile phone, and a software app is provided on the mobile phone to allow the user to adjust the frequency response curve or to select multiple effects and sounds that the digital signal processor 188 applies to the guitar sound. The app can provide a menu of predetermined frequency response curves. Each frequency response curve can be associated with a particular guitar or a brand of guitar that has a particular guitar tone.

Figure 4:
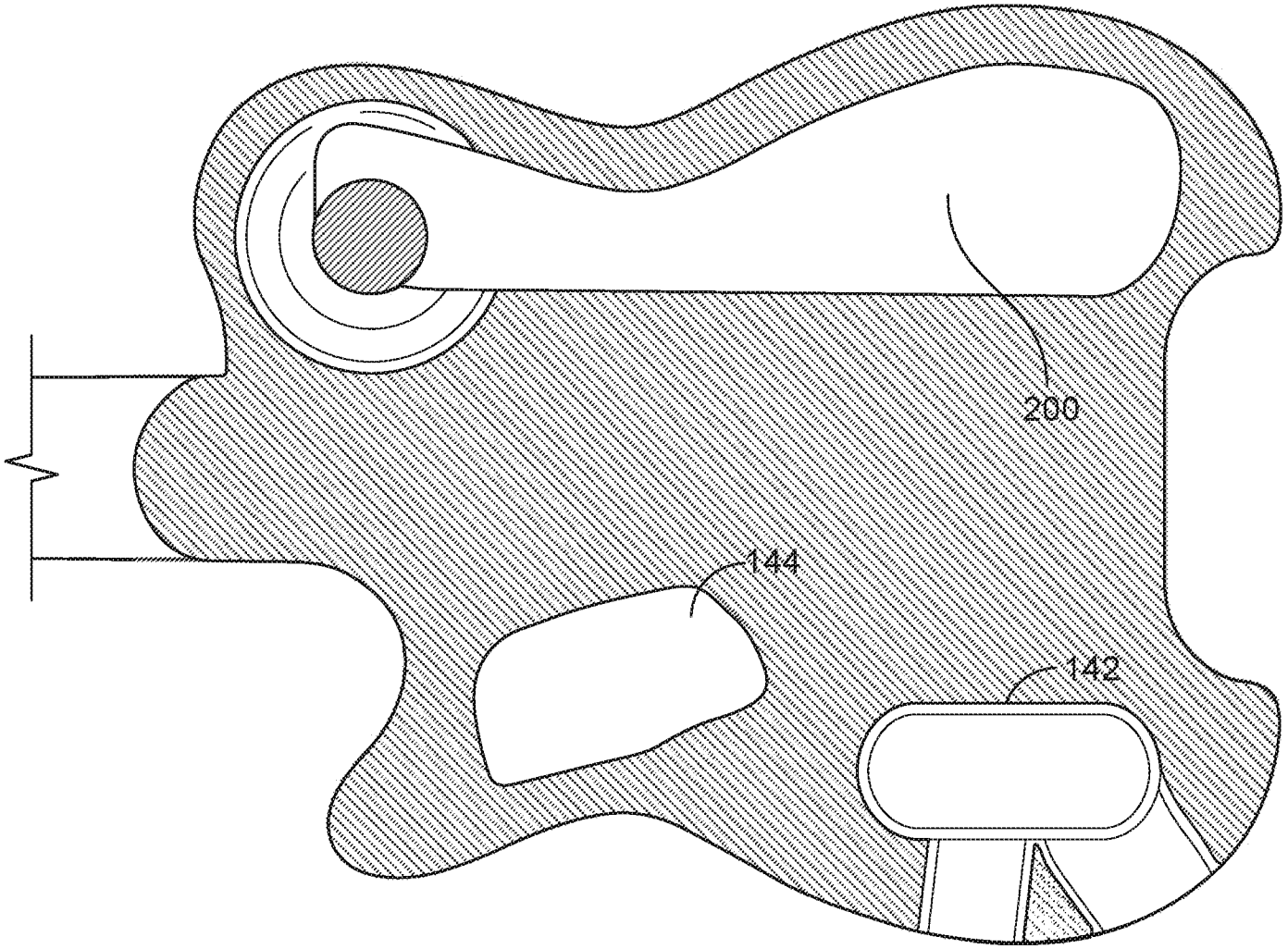
FIG. 4 is a diagram of an example body of the electric guitar.

Referring to FIG. 4, the electric guitar 100 includes a sealed acoustic chamber 200 that provides an acoustic volume associated with the speaker 130. The back of the speaker driver radiates sound into the acoustic chamber 200. The acoustic chamber 200 also reduces the weight of the electric guitar 100 so as to enhance the playability of the guitar. The apparent volume of the acoustic volume can be increased by adding an air-adsorbing material or structure inside the acoustic chamber 200 that effectively increases the air compliance of the acoustic chamber 200. This allows the acoustic chamber 200 to produce a sound effect that is similar to a larger chamber, increasing the low frequency output of the electric guitar 100.

For example, zeolite particles can be used to adsorb air, capturing air molecules when under pressure, which has the effect of making an enclosed volume behave acoustically as if it were larger than it really is. By using zeolite particles, we can obtain more bass response out of a given volume, or the equivalent response in a smaller volume, versus an empty box. In some implementations, the zeolite particles are embedded in a melamine foam. This allows the zeolite particles to be held by the melamine foam in place while providing air paths to all the zeolite particles. For example, adding about 200 cc of the zeolite particles embedded in the melamine foam to an acoustic chamber 200 that has a volume of 400 cc results in the acoustic chamber 200 having an apparent volume of about 800 cc. This means that the acoustic effect of the 400 cc acoustic chamber 200 with the added zeolite particles embedded in the melamine foam is similar to the acoustic effect of a 800 cc acoustic chamber. Additional information about the air-adsorbing material can be found in, e.g., U.S. Pat. Nos. 8,687,836; 8,794,373; 8,991,549; 9,232,299; 9,357,289; 9,749,735; and 9,691,371. The above patents, including U.S. Pat. Nos. 8,687,836; 8,794,373; 8,991,549; 9,232,299; 9,357,289; 9,749,735; and 9,691,371 are hereby incorporated by reference.

In the example shown in FIGS. 2A and 2B, the speaker 130 is positioned at the rear side 132 of the body 102 in the upper bout and near the top portion when the electric guitar 100 is played in the normal position. This allows the speaker 130 to be positioned closer to the musician's ears when playing the electric guitar 100.

Figure 5A:
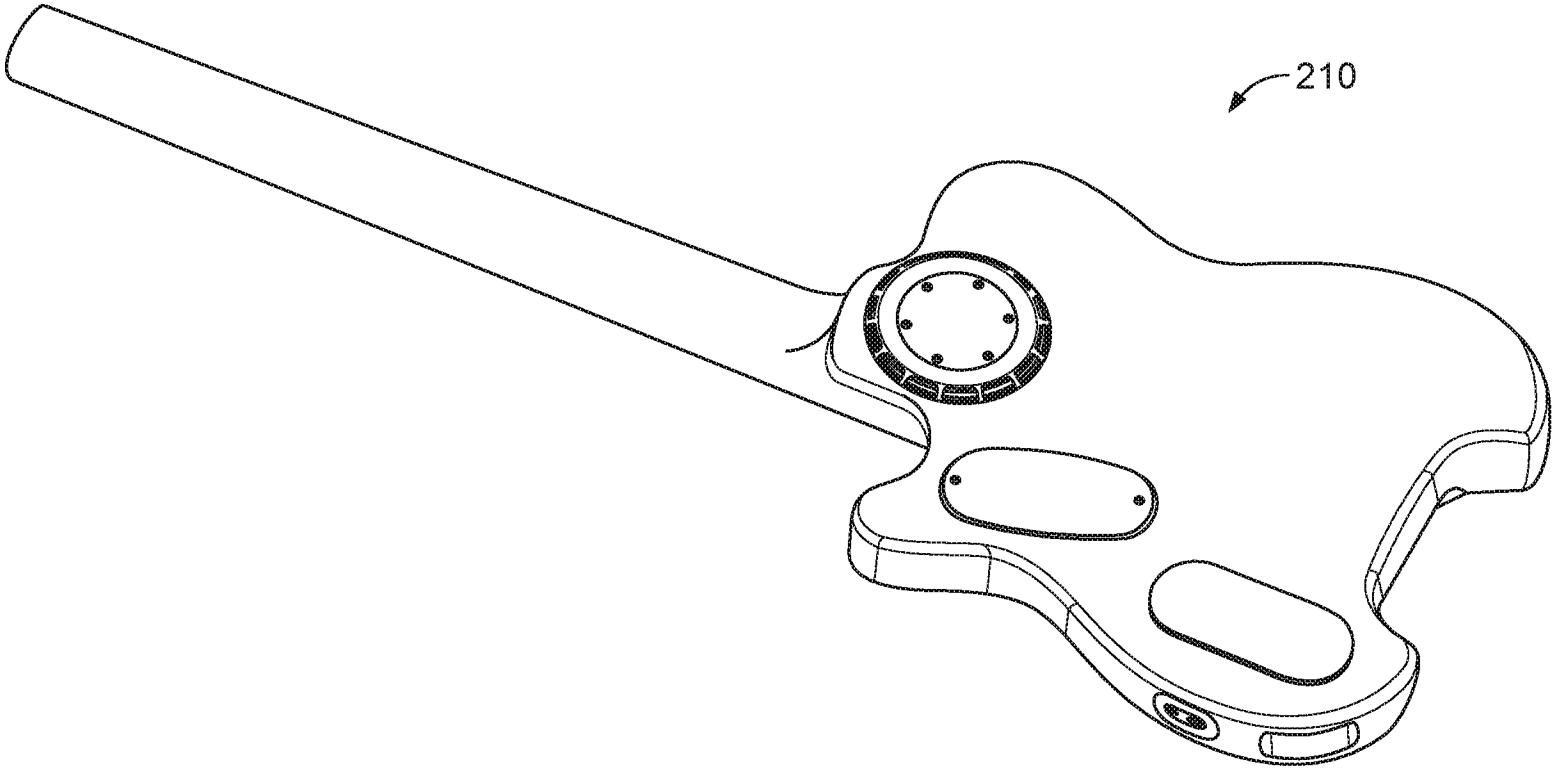
FIGS. 5A, 5B, 6A, and 6B are diagrams of examples of electric guitars.
Figure 5B:
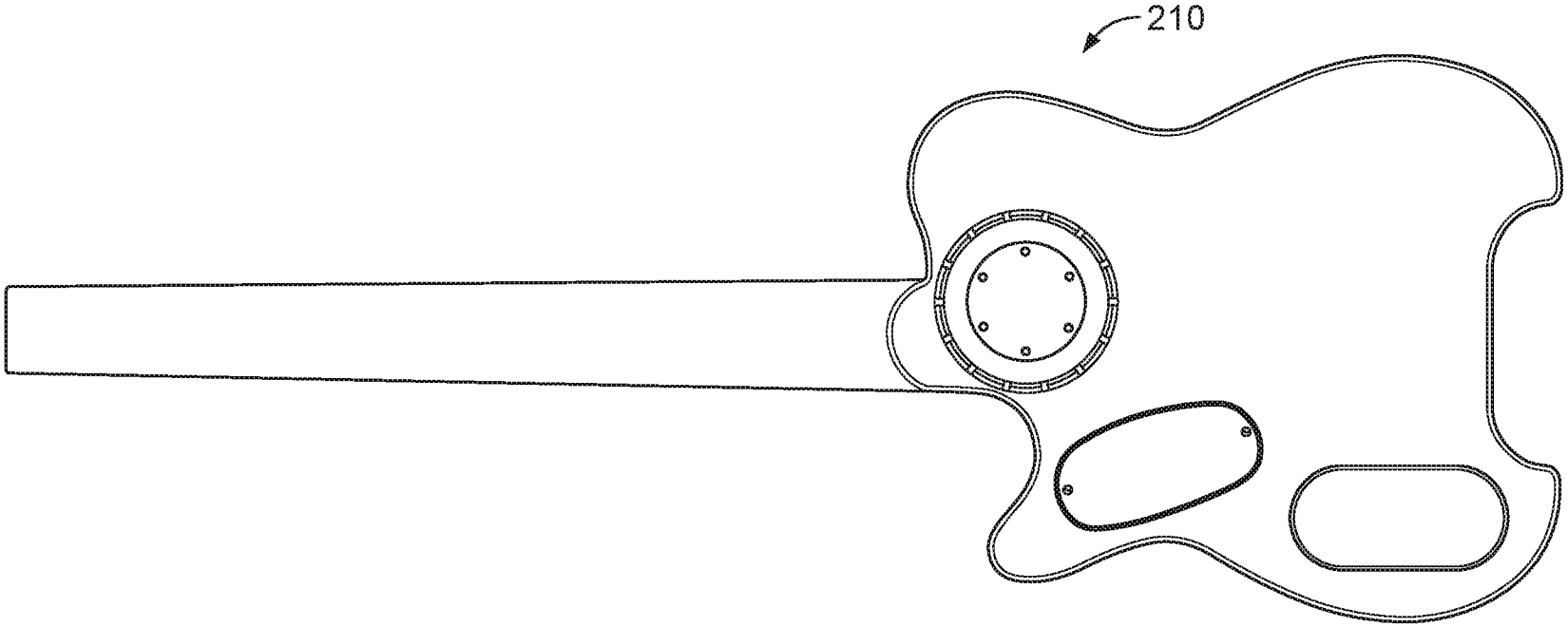

In some implementations, the speaker can be mounted at a location different from the example shown in FIGS. 2A and 2B. FIGS. 5A and 5B show another example of an electric guitar 210 that has a rear-mounted speaker that is positioned closer to a centerline of the guitar body.

Figure 6A:
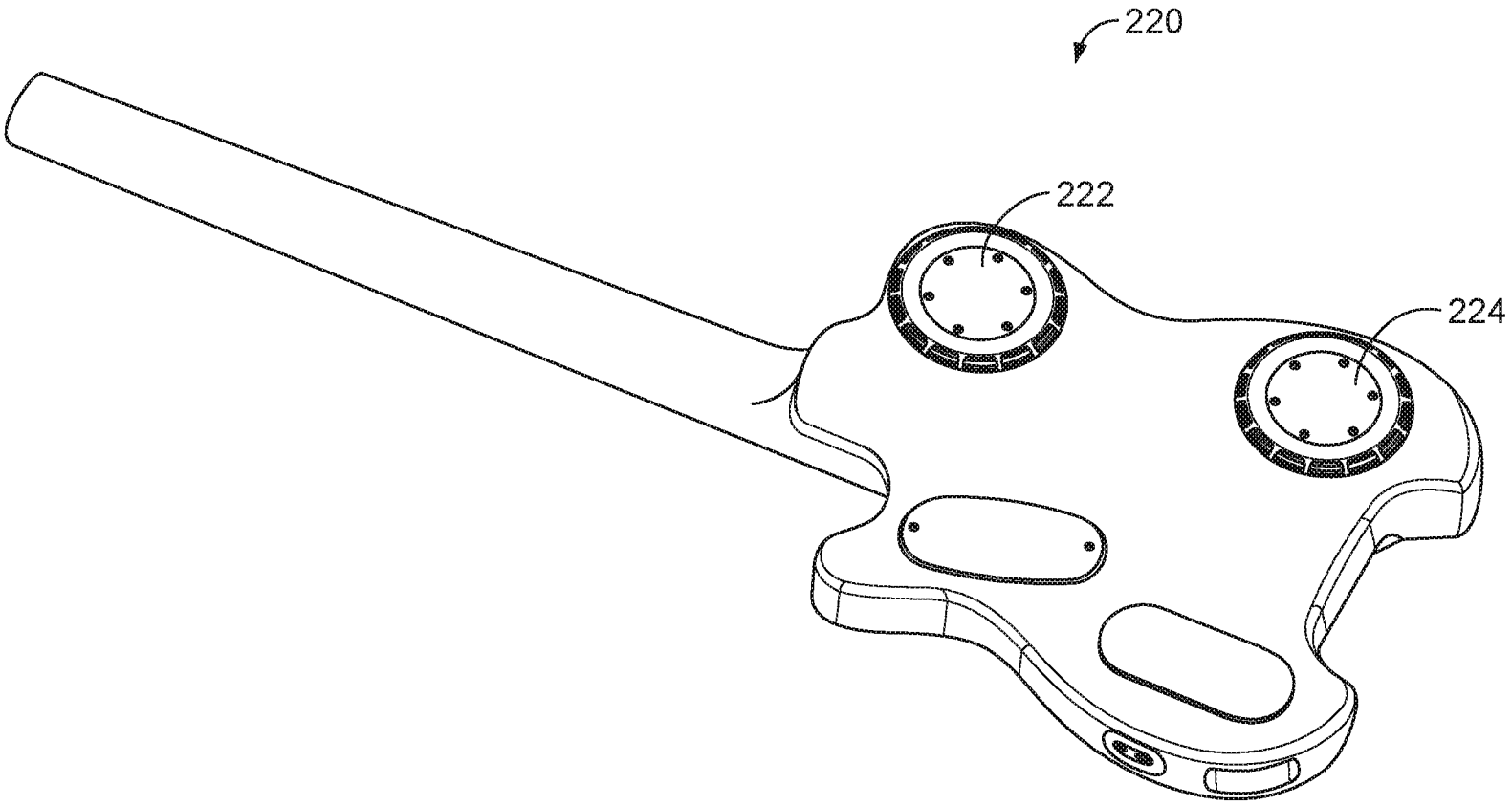
Figure 6B:
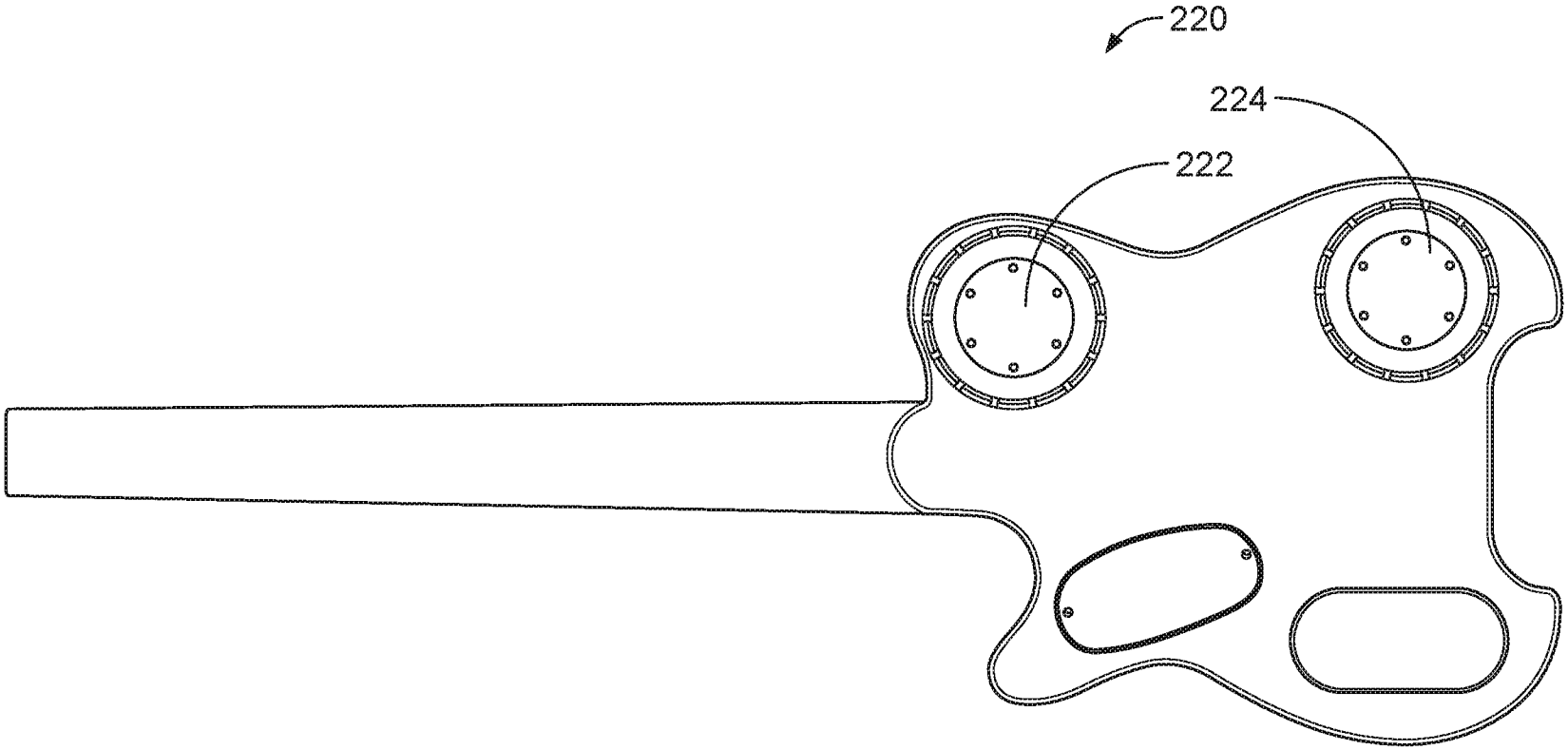

In some implementations, there can be more than one speaker mounted on the rear side of the electric guitar. FIGS. 6A and 6B show an example configuration for an electric guitar 220 that has a first rear-mounted speaker 222 and a second rear-mounted speaker 224. The first and second speakers 222 and 224 can have different sizes and different sound characteristics. For example, the second speaker 224 can have a larger diameter and produce low frequency sounds with a larger volume, as compared to the first speaker 222. For example, the digital signal processor 188 can generate bass line and play it through the second speaker 224 while the first speaker 222 plays the sounds based on the vibrating strings 120.

Figure 7:
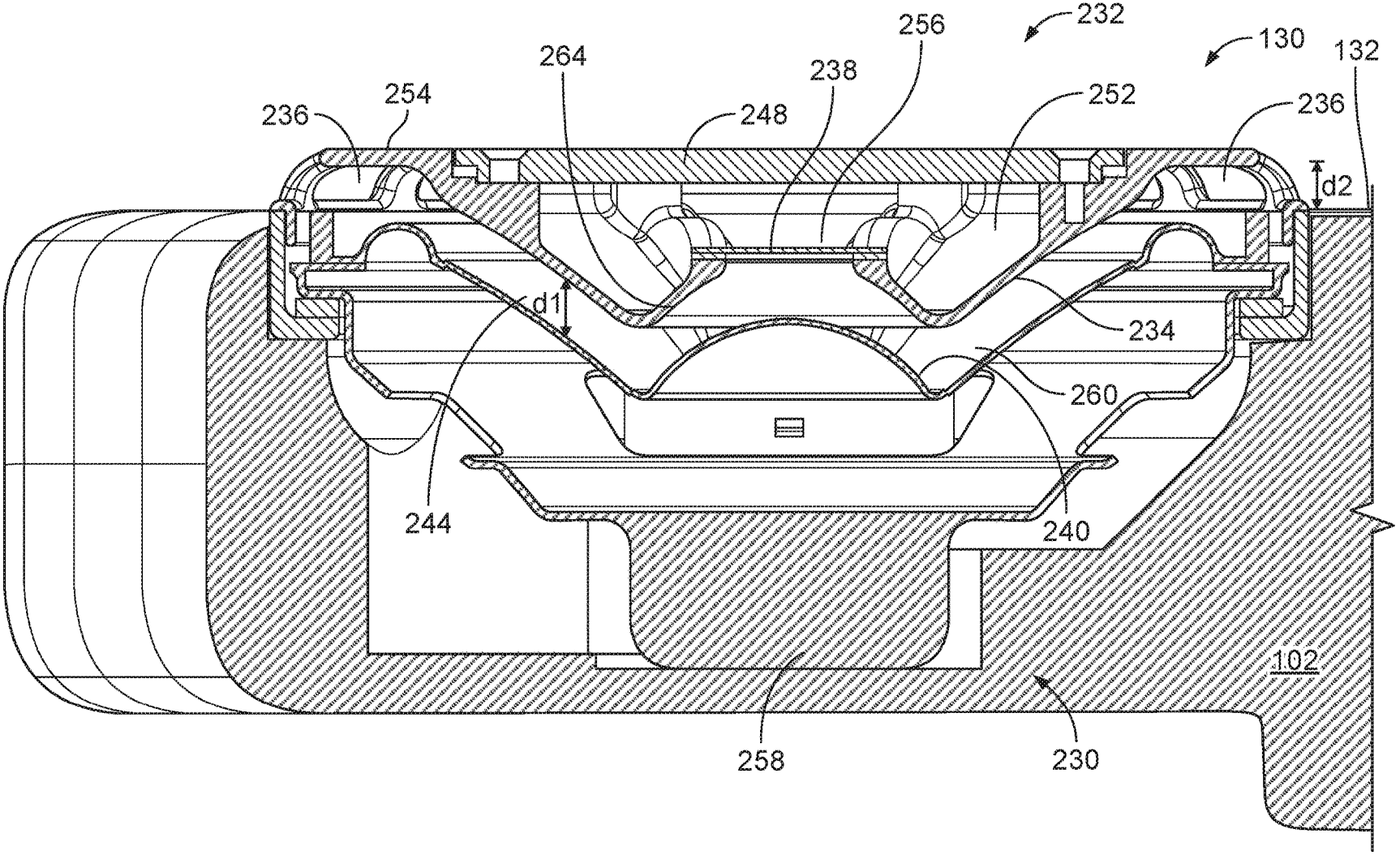
FIG. 7 is a cross-sectional diagram of an example speaker.

FIG. 7 is a cross-sectional diagram of the speaker 130 positioned within the body 102. The speaker 130 includes an acoustic driver 230 and an acoustic deflector 232. The acoustic driver 230 includes a transducer 258 that drives a speaker cone or diaphragm 260. The acoustic deflector 232 is positioned in front of the speaker cone 260, and is shaped similarly to the speaker cone 260, such that there is a narrow air gap between the speaker cone 260 and the acoustic deflector 232. As the speaker cone 260 vibrates, the speaker cone 260 compresses the air between the speaker cone 260 and the acoustic deflector 232, and the sound energy comes out from the perimeter of the speaker 130. In some implementations, the speaker 130 has a round perimeter, resulting in a ring radiation that provides 360° coverage around the speaker 130. The ring radiator causes the acoustic energy to be radiated along a circular opening.

Radiating the sound in a ring has several advantages. First, however, it should be noted that at any point around the ring, the sound radiation is not limited to propagating in the radial direction—it still radiates omnidirectionally, but it does so from all the points around the circumference of the ring radiator. As a result, if the face of the ring radiator is not obstructed, the sound radiating from all the points around the ring will re-combine, constructively, along the axis of the circular radiator, producing a stronger sound field along that axis than in other directions. However, when that face is obstructed, such as by the body of the person playing the guitar, the sound coming from the portions of the circumference that are not obstructed will continue to radiate omnidirectionally, such that the sound can be heard by both the person playing the guitar and anyone standing in front of them.

In some implementations, the acoustic deflector 232 has a nominal truncated conical shape. Acoustic energy generated by the acoustic driver 230 propagates upwards and is deflected into a nominal horizontal direction by a substantially conical surface 234 of the acoustic deflector 232. The acoustic deflector 232 slightly protrudes from the surface of the rear side 132 of the body 102, and several openings 236 are positioned along a circumference of the acoustic deflector 232. The openings 236 are acoustic apertures that pass the horizontally propagating acoustic energy. The openings 236 enable the acoustic energy to propagate through the openings along a circular opening. The propagation of the acoustic energy in a given direction includes a spreading of the propagating acoustic energy, for example, due to diffraction.

In some implementations, the acoustic deflector 232 has a conical outer surface 234 that slopes downwards toward a center axis, that an inverted conical outer surface 264 that slopes upwards toward the center axis and ends at an opening 256. For example, the opening 256 can be covered by a resistive mesh or screen 238, which can be made of an acoustic resistive material (e.g., an acoustic resistive fabric). Here, the terms "upward," "downward," "above," and "below" refer to the directions shown in the figure. The conical outer surface 234 and the inverted conical outer surface 264 of the acoustic deflector 232 are shaped to complement the shape of the acoustic driver 230, which in this example includes the speaker cone 260 and a central dust cap 240.

In some examples, the slope of the surface 234 is not constant. For example, the surface 234 may have a non-linear slant profile such as a parabolic profile or a profile described by a truncated hyperboloid of revolution. The acoustic deflector 232 can be made of any suitable acoustically reflective material. For example, the body of the acoustic deflector 232 can be formed from plastic, metal or other rigid materials, or any suitable combination of the above.

There may be colorization of the acoustic spectrum due to resonances in a volume 244 between the acoustic driver 230 and the acoustic deflector 232.

Figure 8:
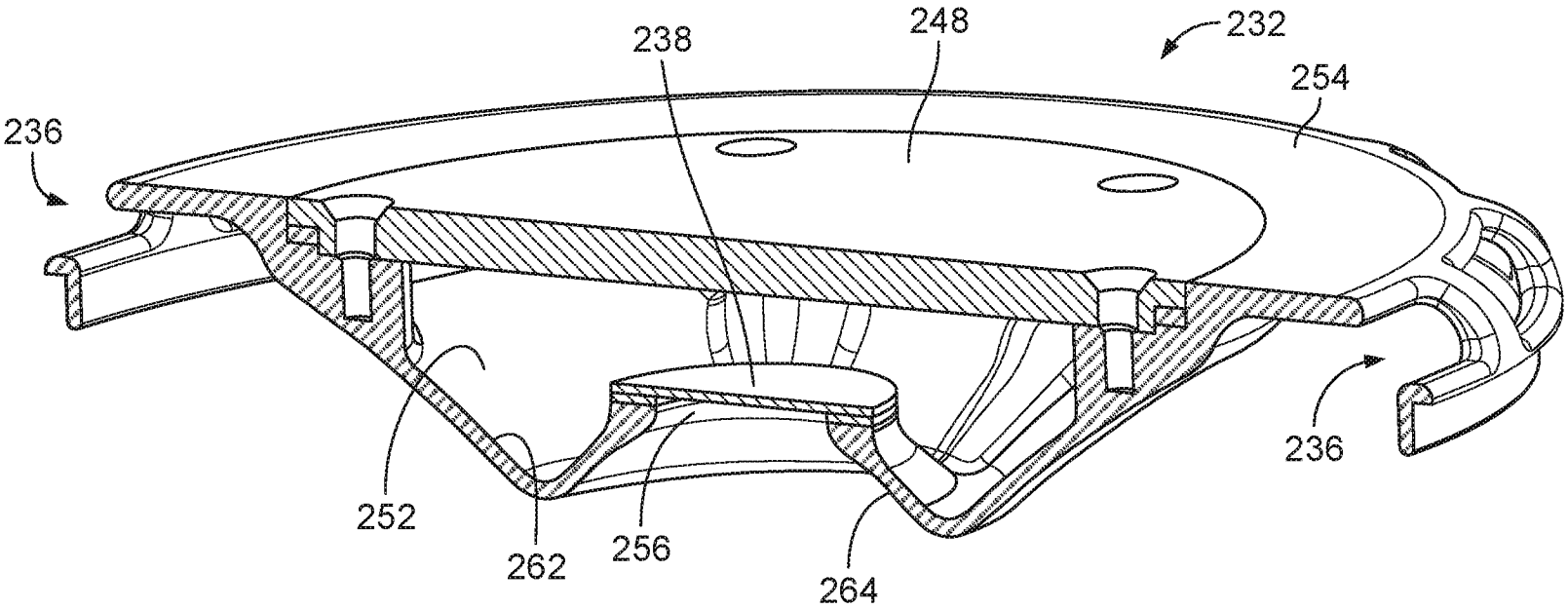
FIG. 8 is a perspective cut-out view of an example acoustic deflector.

FIG. 8 shows a perspective cut-away view of the acoustic deflector 232. Referring to both FIGS. 7 and 8, the acoustic deflector 232 includes an internal volume 252 defined by a conical inner surface 262, a cap 248, and the resistive mesh 238. The combination of the volume 252 and the resistive mesh 238 is tuned to reduce undesirable resonances. In some implementations, the diameter of the opening 256 is chosen so that the resulting attenuation of the acoustic energy propagating from the acoustic driver 230 is limited to an acceptable level while achieving a desirable level of smoothing of the acoustic spectrum.

The acoustic deflector 232 has a top portion 254 that is substantially flat. The cap 248 is also substantially flat and flush with the top portion 254. When a user plays the electric guitar 100 and presses the electric guitar 100 against the user's body, the top portion 254 and the cap 248 are pressed against the user's body. The top portion 254 of the deflector 232 and the cap 248 are configured to form a substantially flat surface that is comfortable to the user.

The top portion 254 of the acoustic deflector 232 slightly protrudes from the surface of the rear side 132, allowing the opening 236 to be positioned above the surface of the rear side 132. This way, even when the top portion 254 and the cap 248 are pressed against the user's body, sound from the speaker 130 can still be emitted sideways through the openings 236, allowing the user to clearly hear the electric guitar sound produced by the speaker 130.

In some examples, the internal volume 252 of the acoustic deflector 232 is about 14 cc, and the resistive mesh has an area of about 1 $cm^2$ and is made of 100 Rayl screen material, which produces an acoustics resistance of about $10^6$ ohms. The gap between the diaphragm 260 and the conical outer surface 234 is about d1=5 mm in the vertical direction. The slot opening 236 is about d2=4 mm tall and extends around the circumference of the acoustic deflector 232.

In general, the acoustic deflector 232 acts as an acoustic smoothing filter by providing a modified acoustic resonance volume between the acoustic driver 230 and the acoustic deflector 232. Adjusting the size and the shape of the internal volume inside the acoustic deflector 232 allows for the acoustic spectrum to be tuned to modify the acoustic spectrum. The profile of the acoustically reflecting surface 234 may be non-linear (i.e., vary from a perfect conical surface) and defined so as to modify the acoustic spectrum. Additional information about the design of the speaker 130 including the acoustic deflector 232 can be found at, e.g., U.S. Pat. No. 9,544,681, hereby incorporated by reference.

The signal processing in the electric musical instruments described in this document can be controlled, at least in part, using one or more computer program products, e.g., one or more computer programs tangibly embodied in one or more information carriers, such as one or more non-transitory machine-readable media, for execution by, or to control the operation of, one or more data processing apparatus, e.g., a programmable processor, a computer, multiple computers, and/or programmable logic components.

The signal processing associated with the electric musical instruments described in this document can be performed by one or more programmable processors executing one or more computer programs to perform the functions described in this document. A computer program can be written in any form of programming language, including compiled or interpreted languages, and it can be deployed in any form, including as a stand-alone program or as a module, component, subroutine, or other unit suitable for use in a computing environment. Control over all or part of the electric musical instrument described in this document can be implemented using special purpose logic circuitry, e.g., an FPGA (field programmable gate array) and/or an ASIC (application-specific integrated circuit).

The digital signal processor 188 can include one or more processors. Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as hard drives, magnetic disks, magneto-optical disks, or optical disks. Machine-readable storage media suitable for embodying computer program instructions and data include various forms of non-volatile storage area, including by way of example, semiconductor storage devices, e.g., EPROM, EEPROM, and flash storage devices; magnetic disks, e.g., internal hard disks or removable disks; magneto-optical disks; and CD-ROM and DVD-ROM discs.

The processes for processing pickup signals described above can be implemented using software for execution on one or more mobile computing devices, and/or one or more remote computing devices. For instance, the software forms procedures in one or more computer programs that execute on one or more programmed or programmable computer systems, either in the mobile computing devices, or remote computing systems (which may be of various architectures such as distributed, client/server, or grid), each including at least one processor, at least one data storage system (including volatile and non-volatile memory and/or storage elements), at least one wired or wireless input device or port, and at least one wired or wireless output device or port. The software may form one or more modules of a larger program, for example, that provides other services related to managing the operations of a home, such as cleaning sessions and security monitoring of the home.

The software may be provided on a medium, such as a CD-ROM, DVD-ROM, or Blu-ray disc, readable by a general or special purpose programmable computer or delivered (encoded in a propagated signal) over a network to the computer where it is executed. The functions may be performed on a special purpose computer, or using special-purpose hardware, such as coprocessors. The software may be implemented in a distributed manner in which different parts of the computation specified by the software are performed by different computers. Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the description have been described. Nevertheless, it will be understood that various modifications may be made without departing from the spirit and scope of the description. For example, the electric guitar can include a microphone input such that a performer may also sing and be amplified along with the guitar sounds. For example, some of the steps described above may be order independent, and thus can be performed in an order different from that described. It is to be understood that the foregoing description is intended to illustrate and not to limit the scope of the invention, which is defined by the scope of the appended claims.

Other embodiments are within the scope of the following claims.

What is claimed is:

1. An electric musical instrument comprising:

a body having a front side and a rear side;

a plurality of strings extending across at least a portion of the front side of the body;

at least one electric pickup to detect vibrations of the strings and generate a pickup signal;

at least one speaker mounted at the rear side of the body, the speaker comprising an acoustic driver and an acoustic deflector, and the acoustic deflector is configured to receive acoustic energy propagating from the acoustic driver and deflect at least a portion of the acoustic energy; and an amplifier to amplify the pickup signal to generate an amplified pickup signal, and drive the at least one speaker based on the amplified pickup signal.

2. The electric musical instrument of claim 1 in which the acoustic deflector comprises a ring radiator which causes the acoustic energy to be radiated along a circular opening.

3. The electric musical instrument of claim 2 in which the circular opening is disposed along an outer circumference of the ring radiator.

4. The electric musical instrument of claim 1 in which the acoustic deflector comprises an acoustically reflective body, and at least a portion of the acoustically reflective body has a truncated conical shape.

5. The electric musical instrument of claim 4 in which the acoustic deflector comprises a cap and an acoustic resistive material, the cap, the acoustic resistive material, and at least a portion of the truncated conical shaped reflective body define a volume, and the acoustic resistive material is configured to enable at least a portion of the acoustic energy received from the acoustic driver to pass the acoustic resistive material and enter the volume between the acoustic resistive material and the cap.

6. The electric musical instrument of claim 1 in which the acoustic deflector comprises an internal volume and an acoustic resistive mesh positioned between the acoustic driver and the internal volume of the acoustic deflector.

7. The electric musical instrument of claim 1 in which the at least one speaker comprises a first speaker and a second speaker mounted at the rear side of the body, each of the first speaker and the second speaker comprises an acoustic driver and an acoustic deflector, and the acoustic deflector is configured to receive acoustic energy propagating from the acoustic driver and deflect at least a portion of the acoustic energy.

8. The electric musical instrument of claim 1, comprising:

an electronic circuit to process the pickup signal, in which the electronic circuit comprises a tone control unit configured to adjust a tone of the pickup signal, and a terminal of the tone control unit is electrically coupled to an input of a high impedance buffer configured to generate an output signal having a voltage level that is substantially the same as a voltage level at the input, wherein the high impedance buffer has an input impedance of at least 10 Mega-ohms, a switch to select between a first mode and a second mode, in which when the first mode is selected, the electronic circuit is configured to provide the pickup signal that is adjusted by the tone control unit to an output jack of the electric musical instrument, and when the second mode is selected, the electronic circuit is configured to provide the output signal from the high impedance buffer to the output jack of the electric musical instrument.

9. The electric musical instrument of claim 8 in which the first mode comprises an electric guitar mode and the second mode comprises an acoustic guitar mode, the electric guitar mode produces at the output jack an audio signal that resembles an audio signal produced by a conventional electric guitar, and the acoustic guitar mode produces at the output jack an audio signal that resembles an audio signal produced by a conventional acoustic guitar.

10. The electric musical instrument of claim 1 in which there is no speaker at the front side of the body.

11. The electric musical instrument of claim 1, comprising air adsorbing material disposed in the acoustic chamber to produce an apparent volume that is larger than an actual volume of the acoustic chamber.

12. The electric musical instrument of claim 1, comprising a digital signal processor configured to process the pickup signal by applying a selected frequency response curve to the pickup signal, in which the selected frequency response is selected from a plurality of pre-stored frequency response curves.

13. The electric musical instrument of claim 12, comprising a user interface configured to control an amount by which the digital signal processor suppresses signal components representing acoustic feedback from the speaker to the pickup.

14. The electric musical instrument of claim 12 in which each of the plurality of frequency response curves is configured to enable the digital signal processor to modify the pickup signal to cause an output of the speaker to resemble a particular guitar or a particular group of guitars.

15. The electric musical instrument of claim 12, comprising:

a storage device configured to store data representing the frequency response curves, and a communication module configured to communicate with a computing device to enable downloading the data representing the frequency response curves from the computing device.

16. The electric musical instrument of claim 1 in which the electric musical instrument comprises at least one of an electric guitar, an electric bass guitar, an electric violin, an electric viola, an electric cello, an electric double bass, an electric banjo, an electric mandolin, or an electric ukulele.

17. The electric musical instrument of claim 1 in which the speaker protrudes from the rear side of the body, the speaker has a top surface that is substantially parallel to a portion of the rear side of the body adjacent to the speaker, and at least one opening is provided between an edge of the top surface and the portion of the rear side of the body adjacent to the speaker to enable sound to be emitted through the at least one opening.

18. A method comprising:

detecting, using at least one electric pickup, vibrations of strings that extend across at least a portion of a front side of a body of an electric musical instrument and generate a pickup signal;

amplifying, using an amplifier, the pickup signal to generate an amplified pickup signal, and driving at least one speaker mounted at a rear side of the body based on the amplified pickup signal, in which the front side and the rear side are at opposite sides of the body, and the speaker includes an acoustic driver and an acoustic deflector;

emitting, from the acoustic driver, acoustic energy; and deflecting, using the acoustic deflector, at least a portion of the acoustic energy received from the acoustic driver.

19. The method of claim 18 in which the acoustic deflector comprises a ring radiator, which directs the acoustic energy to be radiated along a circular opening.

20. The method of claim 19, comprising directing, using the ring radiator, the acoustic energy through openings disposed along an outer circumference of the ring radiator and propagating the acoustic energy from points along the circular opening.

21. The method of claim 20 in which driving at least one speaker mounted at a rear side of the body comprises driving at least a first speaker and a second speaker mounted at the rear side of the body, each of the first speaker and the second speaker comprises an acoustic driver and an acoustic deflector, and the acoustic deflector is configured to receive acoustic energy propagating from the acoustic driver and deflect at least a portion of the acoustic energy.

22. The method of claim 18, comprising driving, using a high impedance buffer, an output jack based on the pickup signal, in which the high impedance buffer has an input impedance greater than 10 Mega-ohms.

23. The method of claim 18, comprising enabling user selection between an electric guitar mode and an acoustic guitar mode, wherein upon user selection of the acoustic guitar mode, driving, using a high impedance buffer, an output jack based on a volume-adjusted and tone-adjusted pickup signal, in which the high impedance buffer has an input impedance greater than 10 Mega-ohms, and wherein upon user selection of the electric guitar mode, driving the output jack based on the volume-adjusted and tone-adjusted pickup signal without using the high impedance buffer.

24. The method of claim 18 in which no speaker is provided at the front side of the body.

25. The method of claim 18, comprising disposing air adsorbing material in an acoustic chamber in the body to produce an apparent volume that is larger than an actual volume of the acoustic chamber.

26. The method of claim 18, comprising controlling a sustain effect of the electric musical instrument by controlling an amount of feedback from the speaker to the pickup.

27. The method of claim 18, comprising processing the pickup signal by applying a selected frequency response curve to the pickup signal, in which the selected frequency response is selected from a plurality of pre-stored frequency response curves.

28. The method of claim 27 in which each of the plurality of frequency response curves is configured to enable the pickup signal to be modified to cause an output of the speaker to resemble a particular guitar or a particular group of guitars.

29. The method of claim 18, comprising communicating, through a communication module, with a computing device and downloading data representing at least one of the frequency response curves, tones, or other sound effects from the computing device, and storing, at a storage device, the downloaded data representing at least one of the frequency response curves, tones, or other sound effects.

30. The method of claim 18 in which the electric musical instrument comprises at least one of an electric guitar, an electric bass guitar, an electric violin, an electric viola, an electric cello, an electric double bass, an electric banjo, an electric mandolin, or an electric ukulele.

* * * * *